US006666243B1

(12) United States Patent
Chiang

(10) Patent No.: US 6,666,243 B1
(45) Date of Patent: Dec. 23, 2003

(54) HEIGHT-ADJUSTABLE WORKPIECE FEEDING DEVICE FOR A WOOD PLANING MACHINE

(76) Inventor: Pei-Lieh Chiang, No. 12, Nan-Ping Rd., Nan Dist., Taichung City (TW)

( * ) Notice: Subject to any disclaimer, the term of this patent is extended or adjusted under 35 U.S.C. 154(b) by 0 days.

(21) Appl. No.: 10/331,704

(22) Filed: Dec. 30, 2002

(30) Foreign Application Priority Data

Oct. 4, 2002 (TW) ..... 091215803 u

(51) Int. Cl.[7] ..... B27C 5/02; B27C 1/00

(52) U.S. Cl. ..... 144/246.1; 144/114.1; 144/117.1

(58) Field of Search ..... 144/114.1, 117.1, 144/129, 130, 246.1, 242.1; 451/357, 451, 456; 409/120, 137

(56) References Cited

U.S. PATENT DOCUMENTS 4,023,421 A * 5/1977 Berlier et al.
6,089,287 A * 7/2000 Welsh et al. ..... 144/117.1
6,546,975 B1 * 4/2003 Liao et al. ..... 144/117.1
6,601,621 B2 * 8/2003 Wixey et al. ..... 144/114.1

* cited by examiner

*Primary Examiner*—W. Donald Bray
(74) *Attorney, Agent, or Firm*—Trop, Pruner & Hu, P.C.

(57) ABSTRACT

In a height-adjustable workpiece feeding device for a wood planing machine, two rollers are journalled on two cam follower units which are respectively slidable along two guideways in a support carriage between upper and lower positions. A connecting rod unit has two cam units secured thereon, and is rotatable transverse to the rollers so as to synchronously rotate the cam units between first and second positions, where first and second regions of cam surfaces of the cam units abut against the cam follower units, respectively, thereby placing the cam follower units, as well as the rollers, in the upper and lower positions.

7 Claims, 11 Drawing Sheets

HEIGHT-ADJUSTABLE WORKPIECE FEEDING DEVICE FOR A WOOD PLANING MACHINE

CROSS-REFERENCE TO RELATED APPLICATION

This application claims priority of Taiwanese Application No. 091215803, filed on Oct. 4, 2002.

BACKGROUND OF THE INVENTION

1. Field of the Invention

This invention relates to a height-adjustable workpiece feeding device for a wood planing machine, more particularly to a height-adjustable workpiece feeding device with feed-in and take-out rollers which can be moved synchronously in an upright direction relative to a worktable of the wood planing machine.

2. Description of the Related Art

Referring to FIG. 1, a conventional wood planing machine is shown to include a mounting frame 11, a worktable 13 which is movably mounted on the mounting frame 11, a support carriage 12 which is movably mounted above the worktable 13 to confine a working passage 100 therebetween, and rubber feed-in and take-out rollers 141 (only one is shown) which are rotatably and respectively mounted on two sides of the support carriage 12. A height-adjusting member includes four sliding blocks 142 (only two are shown) which are respectively disposed on two ends of the rollers 141, four adjusting rods 143 (only two are shown) which are respectively disposed on top sides of the sliding blocks 142 and which extend outwardly of the mounting frame 11, four screw nuts 144 (only two are shown) which are respectively disposed on the adjusting rods 143, and four adjusting nuts 145 (only two are shown) which are respectively disposed on top ends of the adjusting rods 143.

When it is desired to adjust the feed-in and take-out rollers 141 to a desired height, the adjusting nuts 145 are rotated to move the adjusting rods 143 and the rollers 141 upwardly and downwardly. However, since the adjusting rods 143 are moved separately by means of the adjusting nuts 145, it is difficult to maintain the two ends of each of the feed-in and take-out rollers 141 at a same level, and it is likewise difficult to maintain the feed-in and take-out rollers 141 at a same level, thereby requiring calibration, which is time-consuming and inconvenient.

SUMMARY OF THE INVENTION

The object of the present invention is to provide a height-adjustable workpiece feeding device for a wood planing machine, which permits convenient height adjustment of feed-in and take-out rollers of the device.

According to this invention, the height-adjustable workpiece feeding device includes a support carriage for supporting a cutter shaft of a wood planing machine thereon. The support carriage has right and left carriage sides which are respectively mounted on right and left sides of a mounting frame and above a worktable, and feed-in and take-out sides opposite to each other in a transverse direction. The support carriage is movable in an upright direction, and has two guideways which are disposed in the feed-in and take-out sides, respectively. Each of the guideways extends in the upright direction.

Two cam follower units are respectively received in the guideways and are respectively slidable along the guideways between upper and lower positions relative to the worktable. Each of the cam follower units has an engaging surface which faces downwardly.

Feed-in and take-out rollers are respectively journalled on the cam follower units so as to be rotatable about a first axis parallel to a cutter axis of the cutter shaft.

A connecting rod unit has two rod ends which are respectively mounted on the feed-in and take-out sides of the support carriage, and which are rotatable about a second axis transverse to the first axis.

Two cam units are respectively secured on the rod ends of the connecting rod. Each of the cam units has a cam surface which includes a first region and a second region that is disposed behind the first region in a clockwise direction about the second axis. As such, the cam units are synchronously rotatable by the connecting rod unit between a first position, where the first regions of the cam units respectively abut against the engaging surfaces of the cam follower units so as to place the cam follower units in the upper position, and a second position, where the second regions of the cam units respectively abut against the engaging surfaces of the cam follower units so as to place the cam follower units in the lower position.

Each of two biasing members is disposed to bias each of the cam follower units towards the cam surface of a respective one of the cam units.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
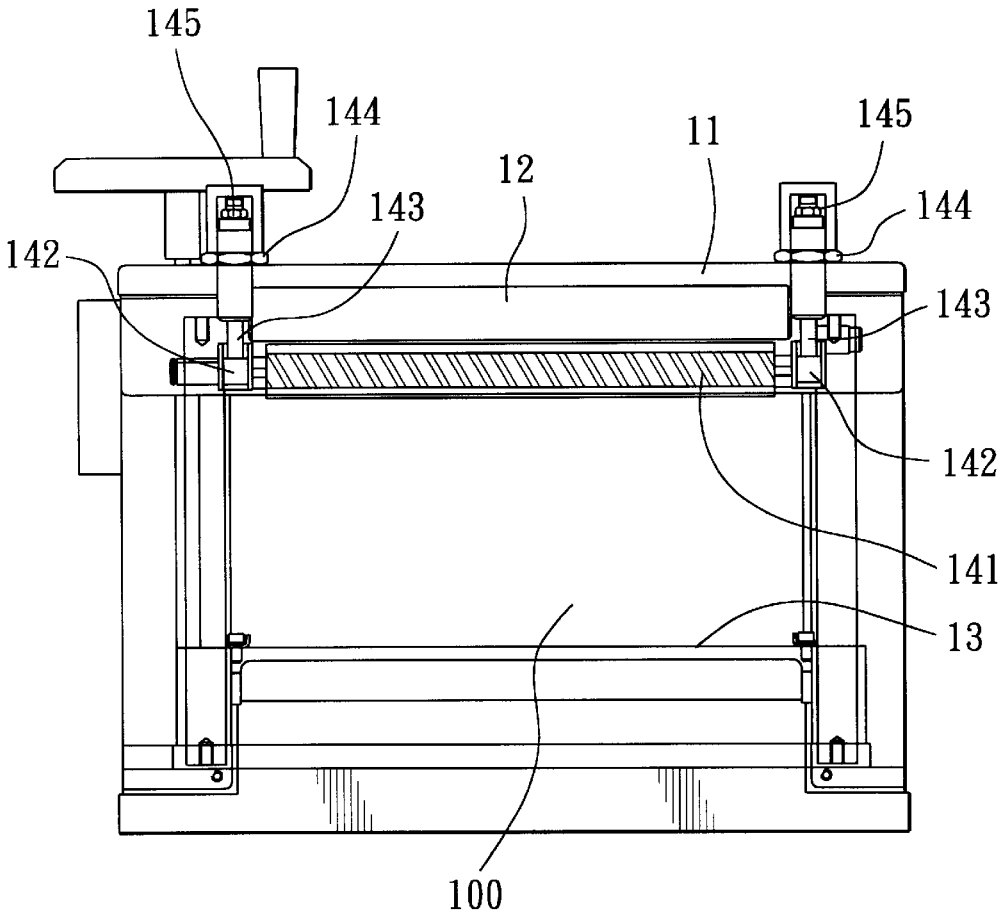
FIG. 1 PRIOR ART
FIG. 1 is a schematic side view of a conventional wood planing machine.
Figure 2:
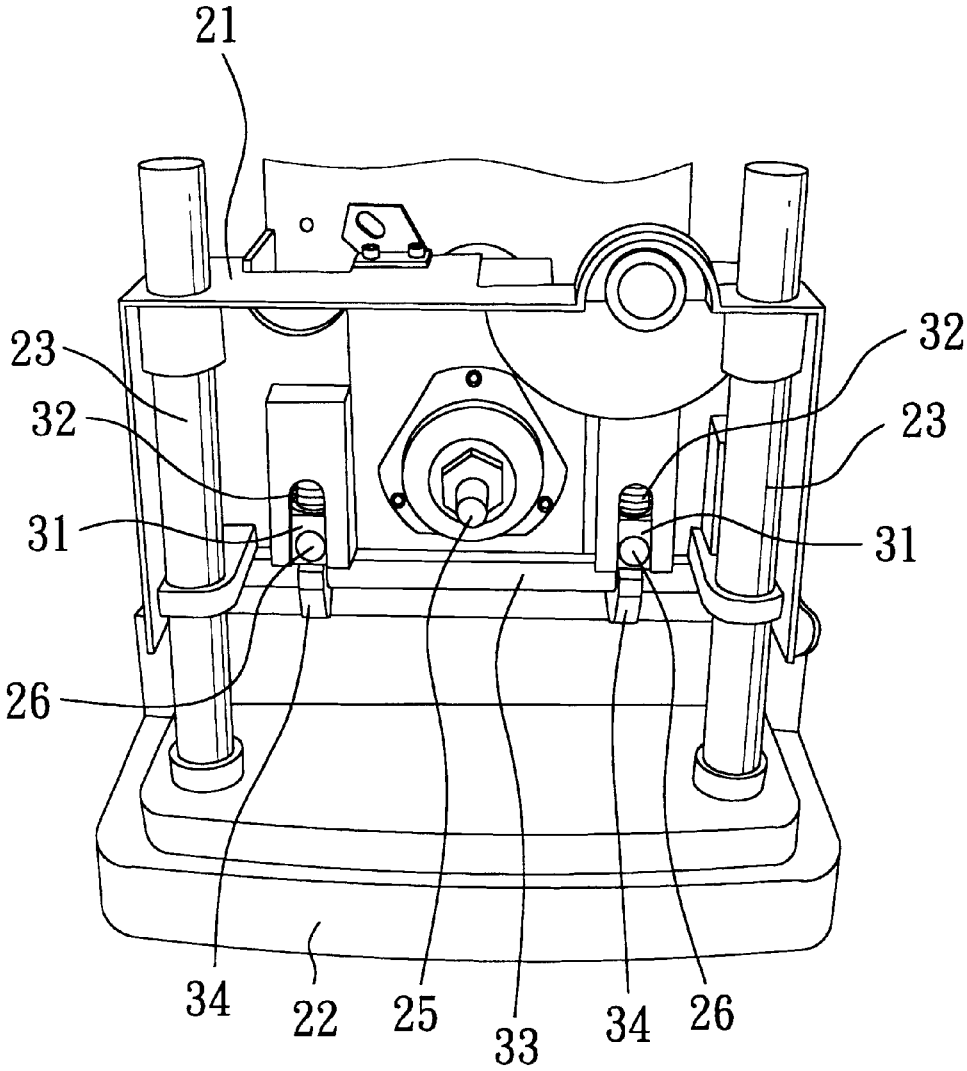
FIG. 2 is a fragmentary perspective view of a preferred embodiment of a height-adjustable workpiece feeding device according to this invention when incorporated in a wood planing machine.
Figure 3:
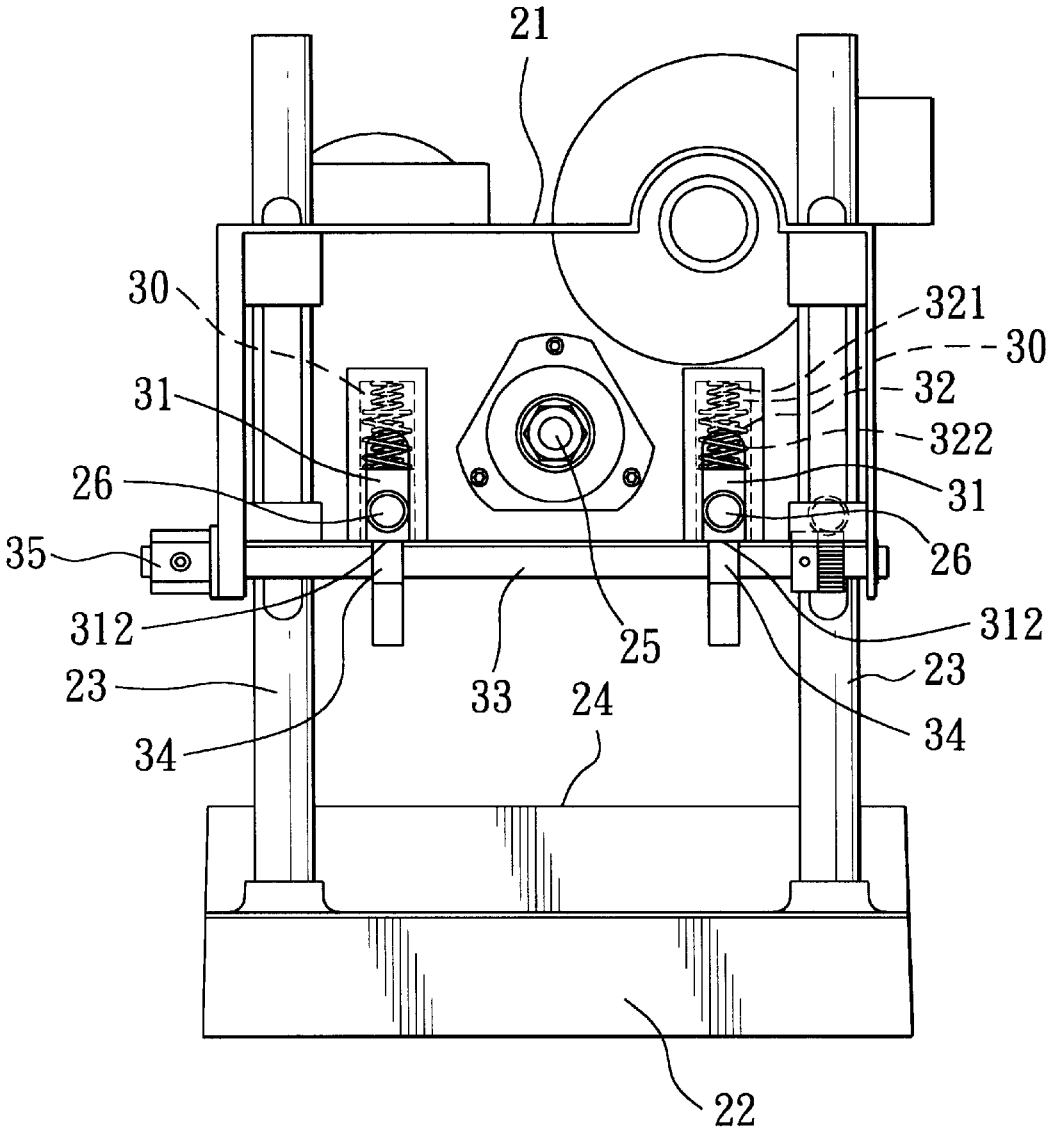
FIG. 3 is a schematic side view of the preferred embodiment when incorporated in the wood planing machine.

Referring to FIGS. 2 and 3, the preferred embodiment of a height-adjustable workpiece feeding device according to the present invention is shown to be mounted on a wood planing machine that includes a mounting frame 22 with two right side columns 23 and two left side columns 23 spaced apart from each other in a longitudinal direction, a worktable 24 mounted on lower portions of the columns 23 for supporting a workpiece (not shown) thereon, and a cutter shaft 25 driven by a motor (not shown) to be rotatable about a cutter axis in the longitudinal direction.

The height-adjustable workpiece feeding device is shown to comprise a support carriage 21, two cam follower units, feed-in and take-out rollers 26, a connecting rod unit, two cam units, and two biasing members.

Figure 4:
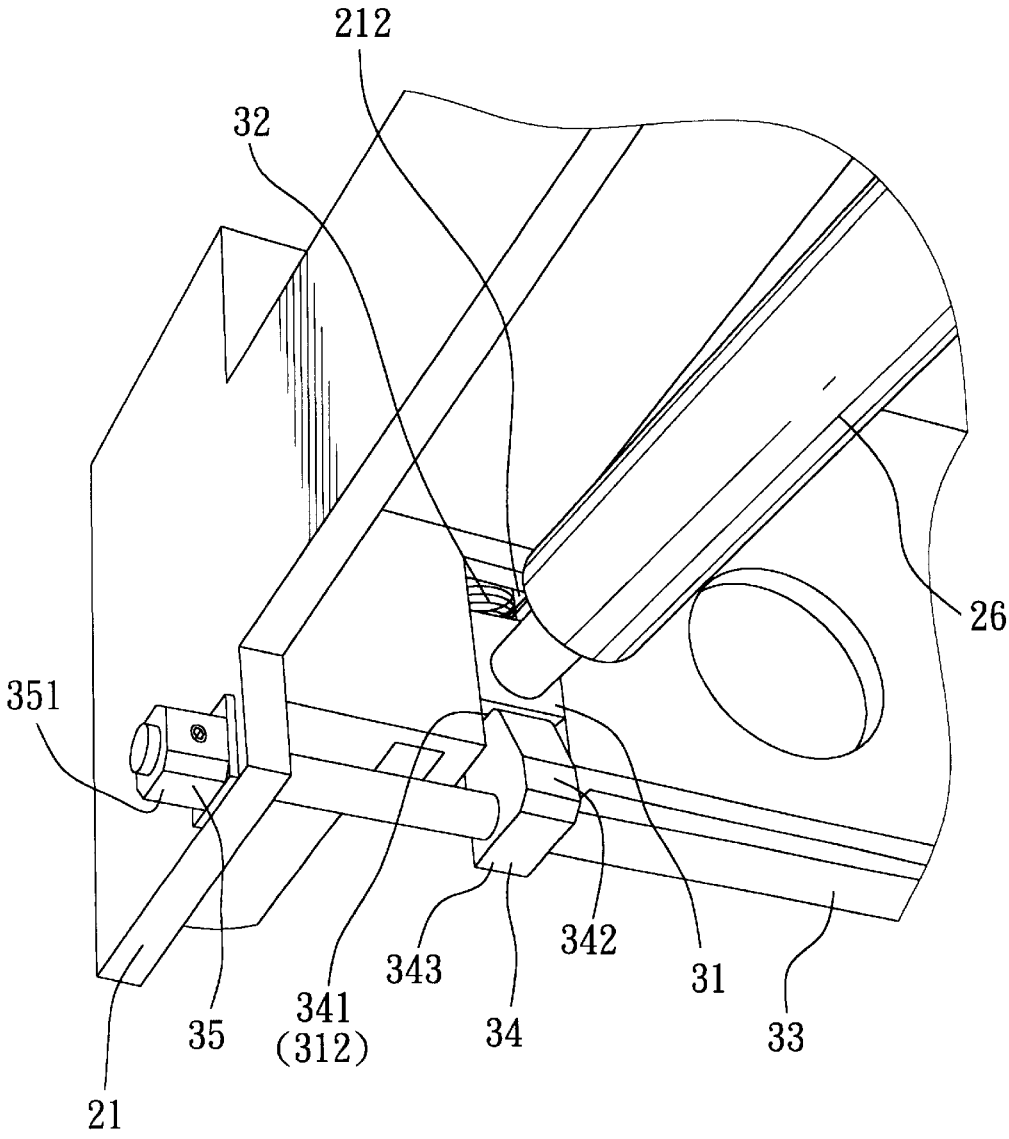
FIG. 4 is a fragmentary perspective view of a portion of the preferred embodiment.

The support carriage 21 is adapted for supporting the cutter shaft 25 thereon. The support carriage 21 has right and left carriage sides which are adapted to be respectively sleeved on the right and left side columns 23 and to be disposed above the worktable 24, and feed-in and take-out sides opposite to each other in a transverse direction relative to the longitudinal direction such that the support carriage 21 is movable in an upright direction transverse to the longitudinal and transverse directions. The support carriage 21 has two guideways which are disposed in the feed-in and take-out sides, respectively. Each of the guideways includes right and left guiding grooves 30 which are respectively formed in the right and left carriage sides and each of which extends in the upright direction to terminate at an upper inner wall surface of the support carriage 21. The upper inner wall surface has an engaging concavity 212, as shown in FIGS. 3 and 4.

Each of the cam follower units includes right and left followers 31 which are respectively received in the right and left guiding grooves 30 of a respective one of the guideways, and which are slidable therealong to a predetermined position relative to the worktable 24. Each of the right and left followers 31 has an engaging surface 312 which faces downwardly.

Each of the feed-in and take-out rollers 26 has right and left roller ends which are respectively journalled on the right and left followers 31 of a respective one of the cam follower units so as to be rotatable about a first axis parallel to the cutter axis.

The connecting rod unit includes right and left rods 33 which are respectively and rotatably mounted on the right and left carriage sides of the support carriage 21. Each of the right and left rods 33 has front and rear rod ends which are respectively mounted on the feed-in and take-out sides of the support carriage 21, and which are rotatable about a second axis transverse to the first axis.

Figure 10:
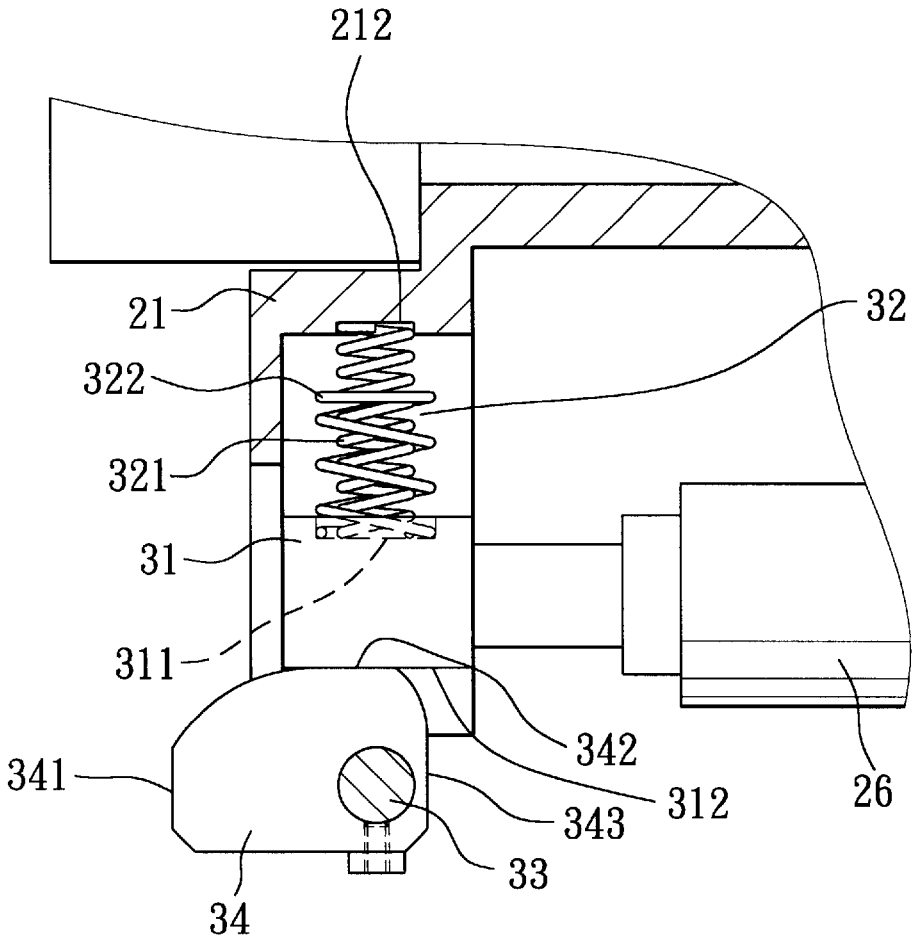
FIG. 10 is a partly sectional view showing the cam in a second position.
Figure 11:
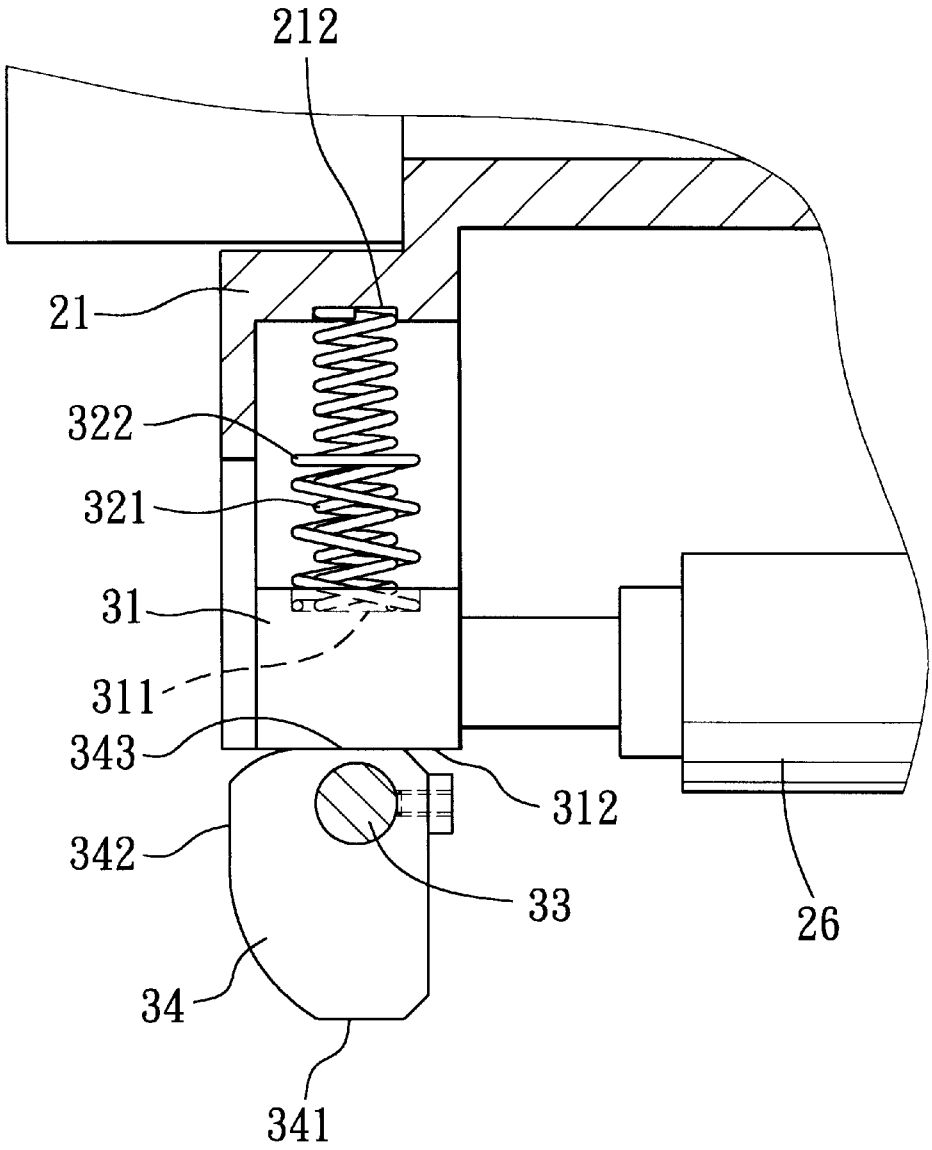
FIG. 11 is a partly sectional view showing the cam in a third position.

Each of the cam units includes right and left cams 34. The right cams 34 of the cam units are respectively secured on the front and rear rod ends of the right rod 33. The left cams 34 of the cam units are respectively secured on the front and rear rod ends of the left rod 33. With reference to FIG. 4, each of the right and left cams 34 has a cam surface which includes first, second and third regions 341,342,343 that are disposed one behind another in a clockwise direction about the second axis. As such, when one of the right and left rods 33 is rotated, the cams 34 secured thereon are rotated synchronously therewith among a first position, where the first regions 341 of the cams 34 respectively abut against the engaging surfaces 312 of the respective followers 31 so as to place the followers 31 in an upper position, as shown in FIG. 9, a second position, where the second regions 342 of the cams 34 respectively abut against the engaging surfaces 312 of the respective followers 31 so as to place the followers 31 in an intermediate position, as shown in FIG. 10, and a third position, where the third regions 343 of the cams 34 respectively abut against the engaging surfaces 312 of the respective followers 31 so as to place the followers 31 in a lower position, as shown in FIG. 11.

Figure 9:
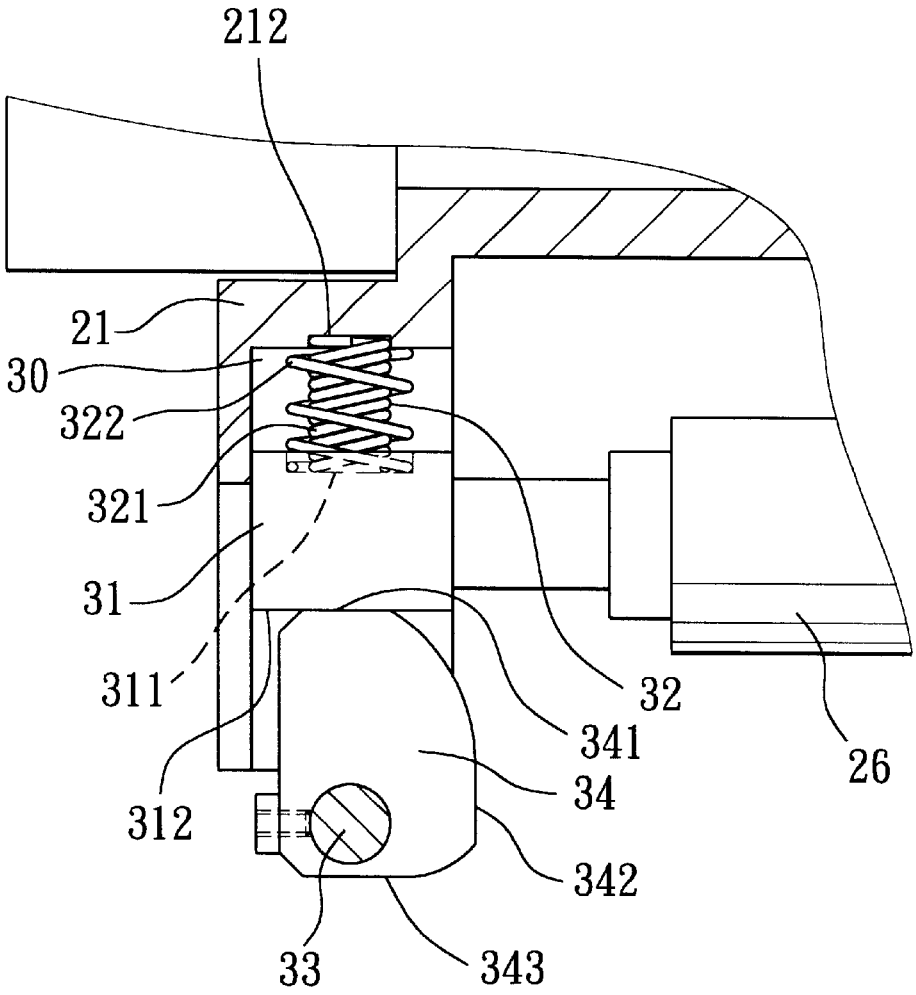
FIG. 9 is a partly sectional view showing a cam of the preferred embodiment in a first position.

With reference to FIGS. 3 and 9, each of the biasing members includes two coiled springs 32, each of which is disposed in a respective one of the right and left guiding grooves 30 of a respective one of the guideways so as to bias the respective follower 31 toward the corresponding cam 34. Each coiled spring 32 includes an inner compression spring part 321 which has two ends that respectively abut against the respective engaging concavity 212 and an abutting groove 311 in the respective follower 31, and an outer compression spring part 322 which is disposed to surround the inner compression spring part 321. The inner and outer compression spring parts 321,322 of each coiled spring 32 extend in opposite spiraling directions so as to stabilize the resilient force of the coiled spring 32.

Figure 7:
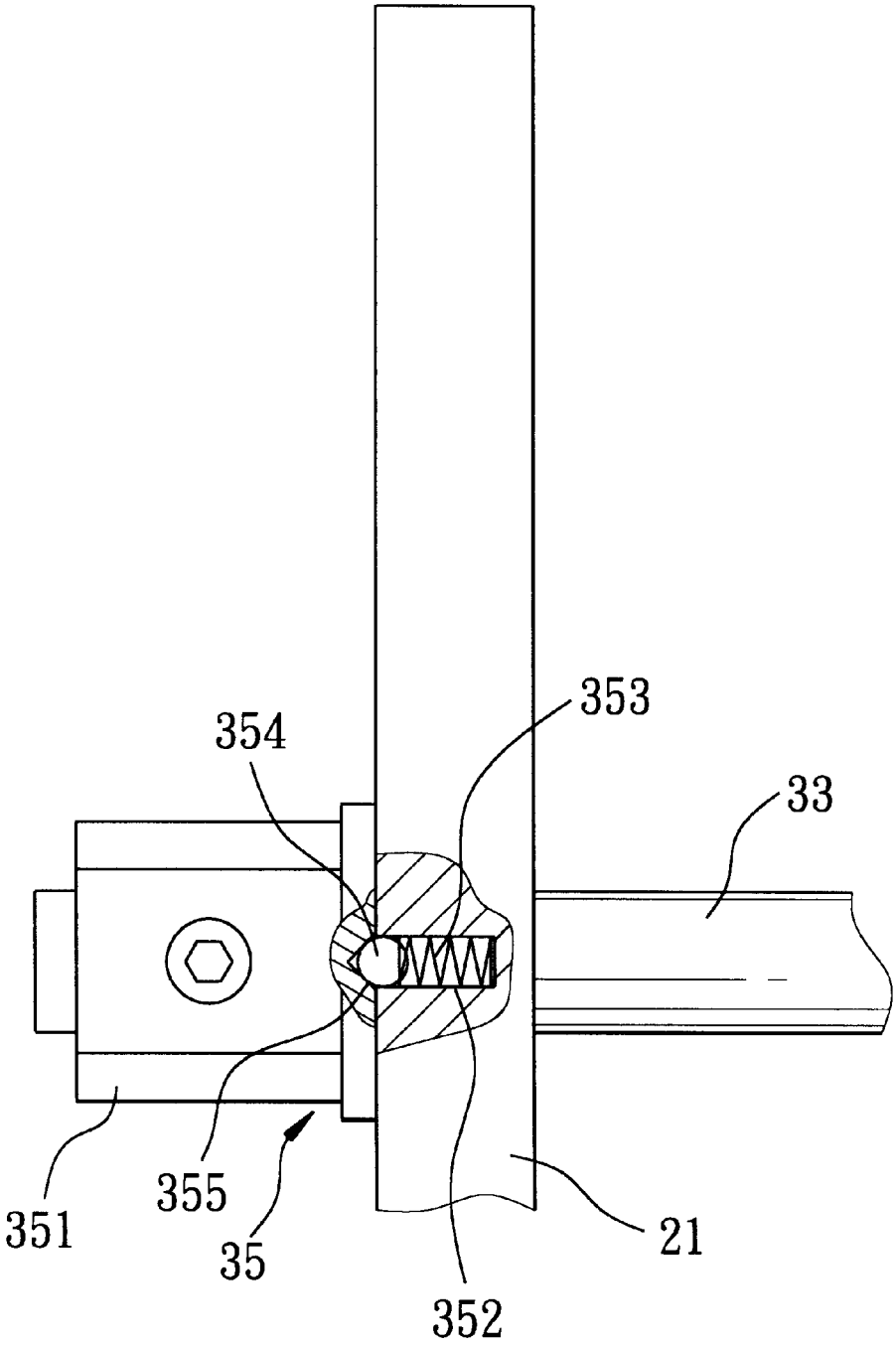
FIG. 7 is a fragmentary, partly sectional schematic view of a retaining member of the preferred embodiment.
Figure 8:
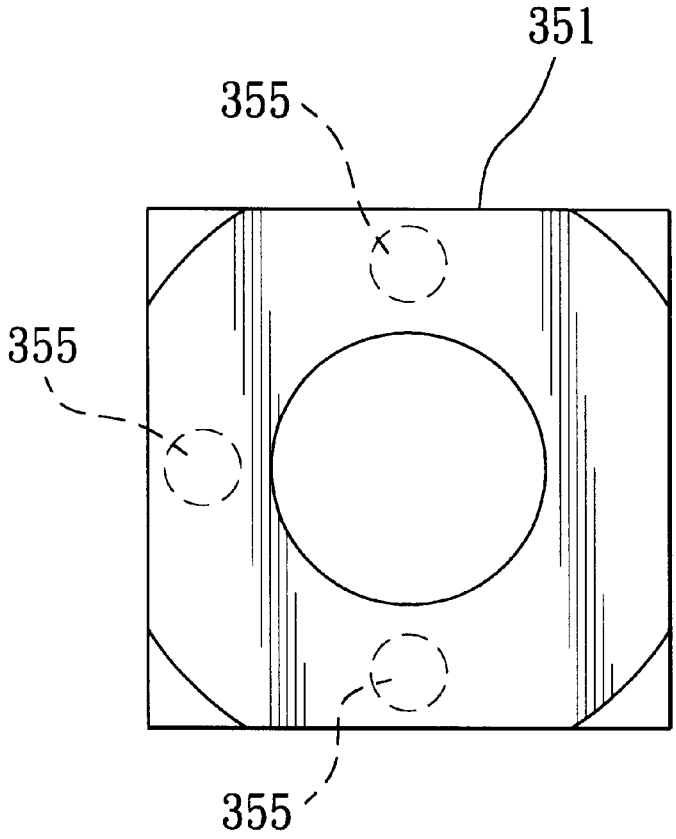
FIG. 8 is a schematic view of a rotary knob of the retaining member.

Referring to FIGS. 4, 7 and 8, a retaining member 35 includes a rotary knob 351 which is secured on the rear rod end of one of the right and left rods 33 adjacent to the take-out side of the support carriage 21 and which has a retaining surface formed with three engaging recesses 355 that are angularly displaced from one another, a mounting slot 352 which is formed in the take-out side, an engaging ball 354 which is received in the mounting slot 352 and which confronts the retaining surface of the rotary knob 351, and a compression spring 353 which is disposed in the mounting slot 352 to bias the engaging ball 354 toward the retaining surface of the rotary knob 351. Thus, when the rotary knob 351 is rotated to rotate the respective rod 33, the engaging ball 354 is pressed inwardly of the mounting slot 352 against the biasing action of the compression spring 353. The engaging ball 354 can engage a corresponding one of the engaging recesses 355 when the cams 34 are in one of the first, second and third positions, thereby preventing rotation of the rod 33.

Figure 5:
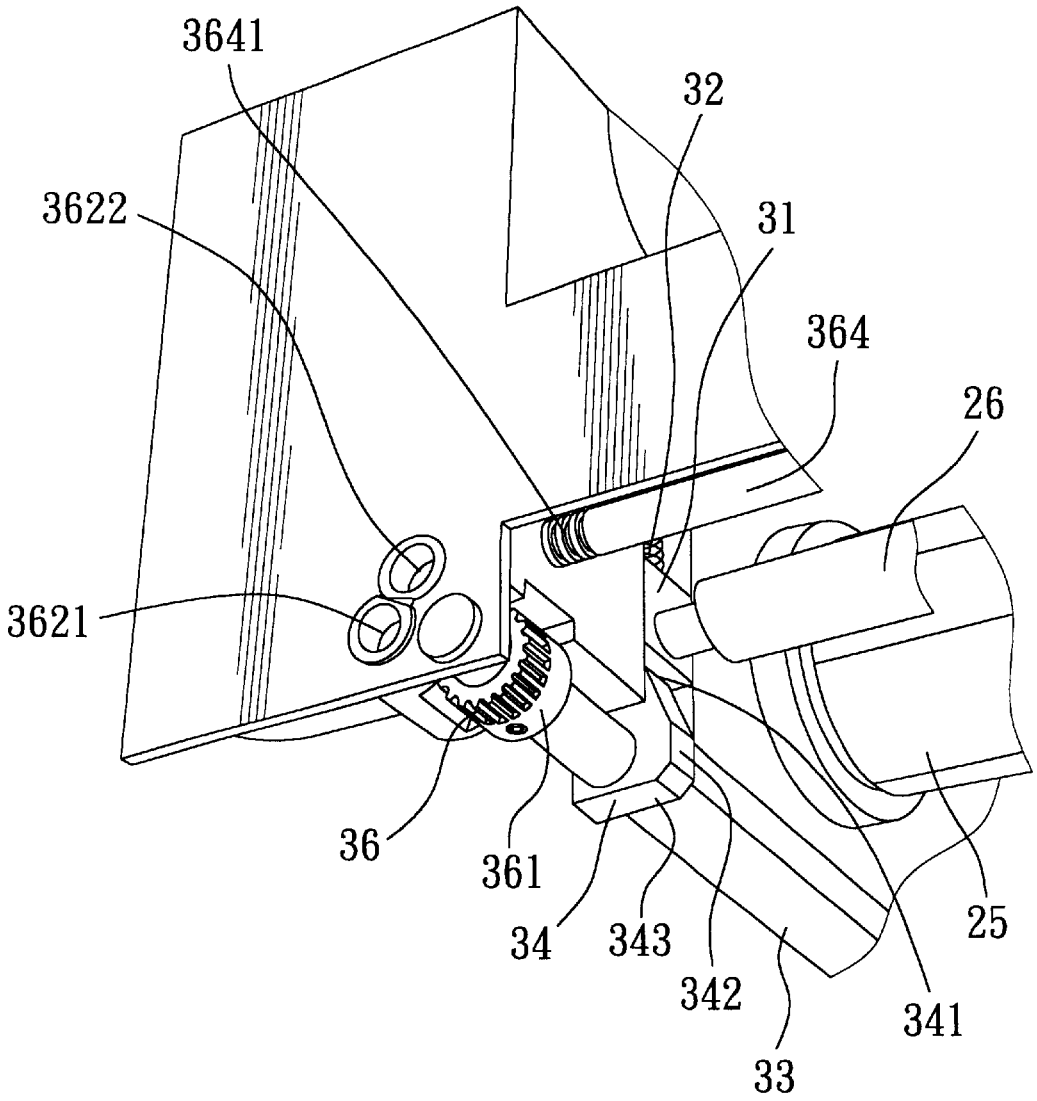
FIG. 5 is a fragmentary perspective view of another portion of the preferred embodiment.
Figure 6:
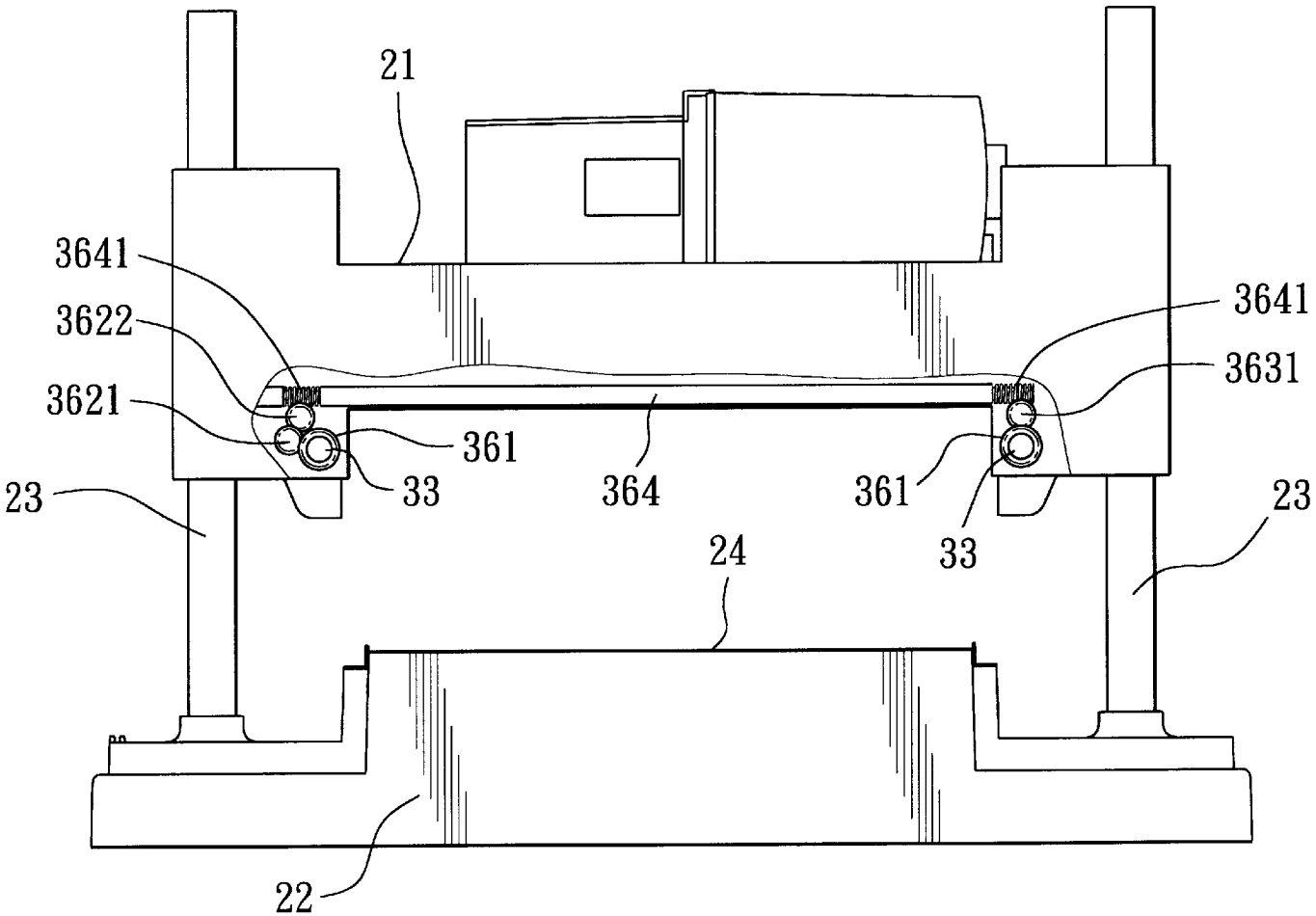
FIG. 6 is a schematic rear view of the preferred embodiment when incorporated in the wood planing machine.

Referring to FIGS. 5 and 6, a coupling mechanism 36 includes right and left gears 361 which are respectively mounted on and which are rotated with the rear rod ends of the right and left rods 33, a first transmitting gear 3621 which is meshed with the left gear 361, a second transmitting gear 3622 which is meshed with the first transmitting gear 3621, a third transmitting gear 3631 which is meshed with the right gear 361, and a transmitting shaft 364 which has right and left shaft ends respectively provided with two worm gears 3641 that are respectively meshed with the second and third transmitting gears 3622,3631. As such, a rotational force applied to rotate one of the right and left rods 33 in one direction will be transmitted to rotate the transmitting shaft 364 so as to rotate synchronously the other one of the right and left rods 33 in the opposite direction.

Referring to FIGS. 3, 4 and 9, in a wood planing operation, a workpiece (not shown) is placed on the worktable 24. The feed-in and take-out rollers 26 are held in an uppermost position where the cams 34 are in the first position, as shown in FIG. 9. When it is desired to move the feed-in and take-out rollers 26 to a lower position, a hand tool (not shown) is used to rotate the rotary knob 351 so as to rotate the respective rod 33 until the engaging ball 354 engages an appropriate one of the engaging recess 355, i.e. the respective cams 34 are in the second or third position as shown in FIG. 10 or 11, thereby lowering the corresponding roller ends of the feed-in and take-out rollers 26 due to the difference in the distances from the respective rods 33 to the first, second and third regions 341,342,343. In addition, since the two rods 33 are rotated synchronously by means of the coupling mechanism 36, the other roller ends of the feed-in and take-out rollers 26 are lowered synchronously.

It is noted that although the cam surface of each cam 34 in this embodiment is shown to include three regions 341, 342,343, it can be configured to have two or more than three regions according to requirements.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A height-adjustable workpiece feeding device for a wood planing machine which includes a mounting frame having right and left sides that are spaced apart from each other in a longitudinal direction, a worktable mounted between the right and left sides of the mounting frame for supporting a workpiece thereon, and a cutter shaft driven to be rotatable about a cutter axis in the longitudinal direction, said device comprising:

a support carriage adapted for supporting the cutter shaft thereon, and having right and left carriage sides which are adapted to be respectively mounted on the right and left sides of the mounting frame and above the worktable, and feed-in and take-out sides opposite to each other in a transverse direction relative to the longitudinal direction, said support carriage being movable in an upright direction transverse to the longitudinal and transverse directions, and having two guideways which are disposed in said feed-in and take-out sides, respectively, each of said guideways extending in the upright direction;

two cam follower units respectively received in said guideways and respectively slidable along said guideways between upper and lower positions relative to the worktable, each of said cam follower units having an engaging surface which faces downwardly;

feed-in and take-out rollers respectively journalled on said cam follower units so as to be rotatable about a first axis parallel to the cutter axis;

a connecting rod unit having two rod ends which are respectively mounted on said feed-in and take-out sides of said support carriage, and which are rotatable about a second axis transverse to the first axis;

two cam units respectively secured on said rod ends of said connecting rod unit, each of said cam units having a cam surface which includes a first region and a second region that is disposed behind said first region in a clockwise direction about the second axis such that said cam units are synchronously rotatable about said connecting rod unit between a first position, where said first regions of said cam units respectively abut against said engaging surfaces of said cam follower units so as to place said cam follower units in the upper position, and a second position, where said second regions of said cam units respectively abut against said engaging surfaces of said cam follower units so as to place said cam follower units in the lower position; and two biasing members, each disposed to bias a respective one of said cam follower units towards said cam surface of a respective one of said cam units.

2. The device of claim 1, wherein each of said guideways includes right and left guiding grooves which are respectively formed in said right and left carriage sides, each of said cam follower units including right and left followers which are respectively received in and slidable along said right and left guiding grooves of a respective one of said guideways, said connecting rod unit including right and left rods which are respectively and rotatably mounted on said right and left carriage sides and each of which has front and rear rod ends serving as said rod ends, respectively, each of said cam units including right and left cams, said right cams of said cam units being respectively secured on said front and rear rod ends of said right rod, said left cams of said cam units being respectively secured on said front and rear rod ends of said left rod, each of said biasing members including two coiled springs which are respectively received in said right and left guiding grooves of a respective one of said guideways.

3. The device of claim 2, further comprising a retaining member disposed to prevent rotation of said connecting rod unit.

4. The device of claim 3, wherein said retaining member includes a rotary knob secured on one of said front and rear rod ends of one of said right and left rods, and having a retaining surface which is formed with two engaging recesses that are angularly displaced from each other about the second axis, an engaging ball disposed in said support carriage and confronting said retaining surface, said engaging ball being movable to engage a respective one of said engaging recesses when said cams are in one of the first and second positions, and a spring disposed to bias said engaging ball toward said retaining surface.

5. The device of claim 2, wherein said right and left rods are rotatable in opposite directions, said device further comprising a coupling mechanism disposed to synchronize rotation of said right and left rods.

6. The device of claim 5, wherein said coupling mechanism includes right and left gears respectively mounted on and rotated with said right and left rods, a first transmitting gear meshed with said left gear, a second transmitting gear meshed with said first transmitting gear, and a third transmitting gear meshed with said right gear, and a transmitting shaft having right and left shaft ends which are respectively provided with two worm gears that are respectively meshed with said second and third transmitting gears, such that a rotational force applied to rotate one of said right and left rods in one direction will be transmitted to rotate said transmitting shaft so as to rotate the other one of said right and left rods in an opposite direction.

7. The device of claim 2, wherein each of said guiding grooves extends in the upright direction to terminate at an upper inner wall surface, each of said coiled springs including an inner compression spring part which has two ends that respectively abut against said upper inner wall surface of a respective one of said guiding grooves and a respective one of said right and left followers, and an outer compression spring part which is disposed to surround said inner compression spring part and which extends in a spiraling direction opposite to that of said inner compression spring part.

* * * * *